US005997219A

United States Patent [19]

Krzysztalowicz et al.

[11] Patent Number: 5,997,219

[45] Date of Patent: Dec. 7, 1999

[54] TUBE-FORMED EXPANSION ROCK BOLT

[75] Inventors: Daniel Krzysztalowicz, Nacka; Bo Ohlson, Saltsjöbaden, both of Sweden

[73] Assignee: Atlas Copco Rock Drill AB, Orebro, Sweden

[21] Appl. No.: 09/125,535

[22] PCT Filed: Jan. 21, 1997

[86] PCT No.: PCT/SE97/00085

§ 371 Date: Oct. 19, 1998

§ 102(e) Date: Oct. 19, 1998

[87] PCT Pub. No.: WO97/31177

PCT Pub. Date: Aug. 28, 1997

[30] Foreign Application Priority Data

Feb. 21, 1996 [SE] Sweden ..... 9600640

[51] Int. Cl.[6] ..... E21D 20/00; F16B 13/04

[52] U.S. Cl. ..... 405/259.3; 405/259.1; 411/19; 411/32; 285/390; 285/901

[58] Field of Search ..... 405/259.1, 259.3, 405/259.5, 288; 411/19, 20, 32, 33; 285/390, 333, 334, 355, 901

[56] References Cited

U.S. PATENT DOCUMENTS

| | | | |
|---|---|---|---|
| 1,733,392 | 10/1929 | Barra | 285/333 X |
| 4,112,637 | 9/1978 | Herbst | 405/259.3 X |
| 4,284,379 | 8/1981 | Chaiko . | |
| 4,366,651 | 1/1983 | Thomas et al. | 411/33 X |
| 4,423,986 | 1/1984 | Skogberg | 405/259.3 |
| 4,459,067 | 7/1984 | Skogberg et al. . | |
| 4,472,088 | 9/1984 | Martin | 405/259.3 |
| 4,509,889 | 4/1985 | Skogberg et al. | 405/259.3 |
| 4,634,317 | 1/1987 | Skogberg et al. | 405/259.3 |
| 4,796,928 | 1/1989 | Carlin et al. | 285/334 X |
| 4,954,017 | 9/1990 | Davis et al. | 405/259.3 |
| 5,306,187 | 4/1994 | Mackal | 285/901 X |
| 5,320,388 | 6/1994 | Lacy et al. | 285/355 X |
| 5,765,969 | 6/1998 | Kareby et al. | 405/259.3 |

FOREIGN PATENT DOCUMENTS

| | | |
|---|---|---|
| 0391119 | 10/1990 | European Pat. Off. . |
| 4220636 | 1/1994 | Germany . |

*Primary Examiner*—David Bagnell
*Assistant Examiner*—Jong-Suk Lee
*Attorney, Agent, or Firm*—Mark P. Stone

[57] ABSTRACT

A tube-formed rock bolt is expandable into contact with the wall in a bore hole without stretching the periphery of the rock bolt. The rock bolt has an elongated tube (12) with a closed cross section. The tube is provided with a longitudinal depressed part (13). End pieces (14, 24) are secured to the ends of the tube, and the end pieces are provided with axial channels (15, 35) having peripheries which provide a seal resulting from deformation of material when the rock bolt is assembled by joining together different sections. By connecting one end (30) of the assembled rock bolt to a high pressure pump (39), the entire assembled rock bolt can be expanded at the same time.

2 Claims, 3 Drawing Sheets

TUBE-FORMED EXPANSION ROCK BOLT

BACKGROUND OF THE INVENTION

The present invention relates to a tubeformed rock bolt. More specifically the invention concerns a tubeformed rock bolt which is formed for being joined to arbitrary length.

In a previously known rock bolt of the above mentioned kind, see U.S. Pat. No. 4,509,889, one can achieve a long rock bolt through entering a rock bolt into a bore hole and expanding it. Then a further bolt is entered on a tube extending from the inner rock bolt and is expanded so that it is fixed on the extending tube. A drawback when setting a long rock bolt comprising several short rock bolts is that one needs a long tool which normally must be bendable in order to set the rock bolt which is to be innermost in the bore hble. Another drawback is that the rock bolt at the joints becomes substatially weaker since the connection is obtained through friction. This force becomes small because the extending tube has small diameter and thus a small outer surface.

SUMMARY OF THE INVENTION

The present invention, which is defined in the subsequent claim, aims at achieving a rock bolt which can easily be joined to arbitrary length and which has perfect strength along the whole length after assembly.

BRIEF DESCRIPTION OF THE DRAWINGS

An embodiment of the invention is described below with reference to the accompanying drawings in which FIG. 1 schematically shows setting of a rock bolt.

DESCRIPTION OF THE BEST MODES FOR CARRYING OUT THE INVENTION

Figure 1:
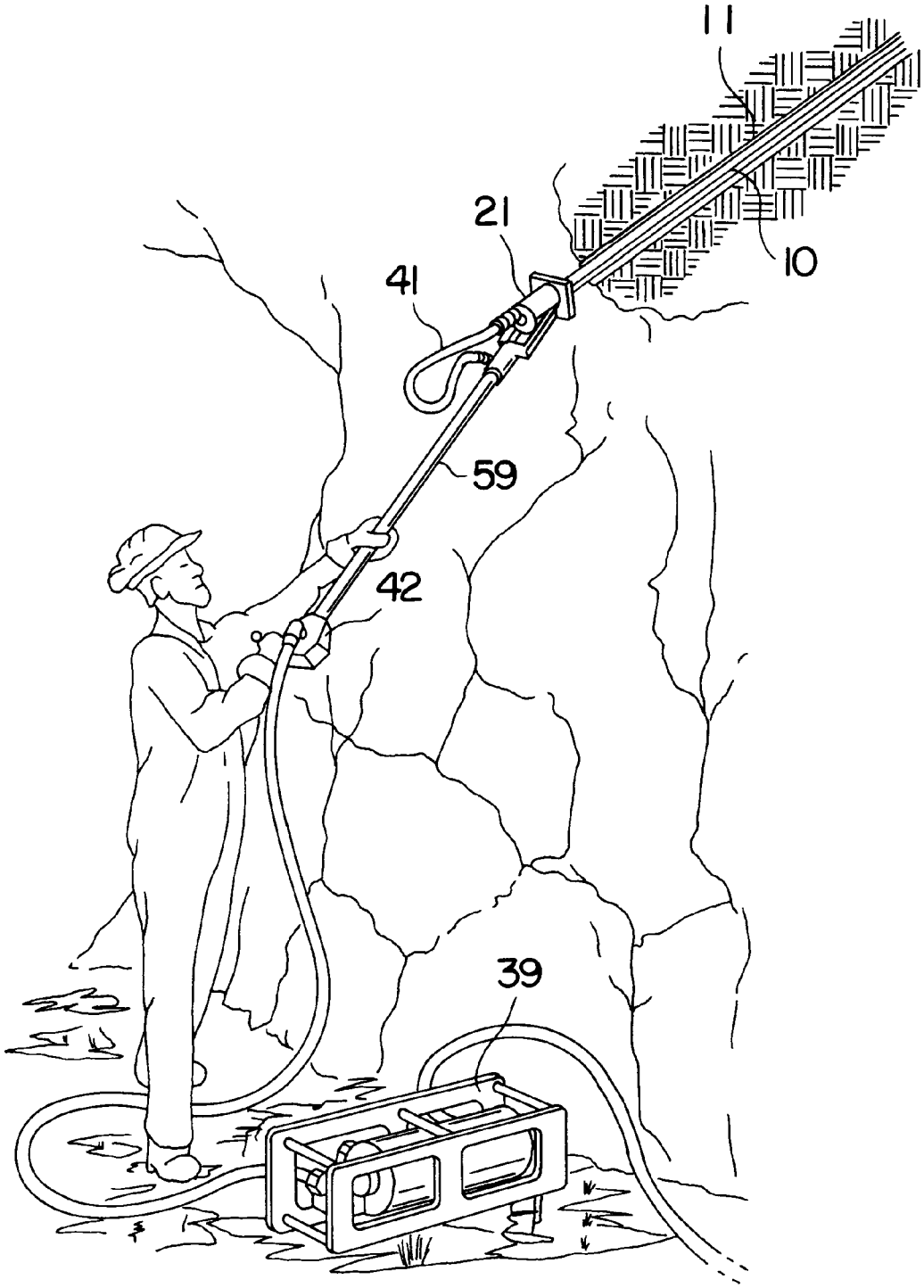
FIG. 1 PRIOR ART
Figure 3:
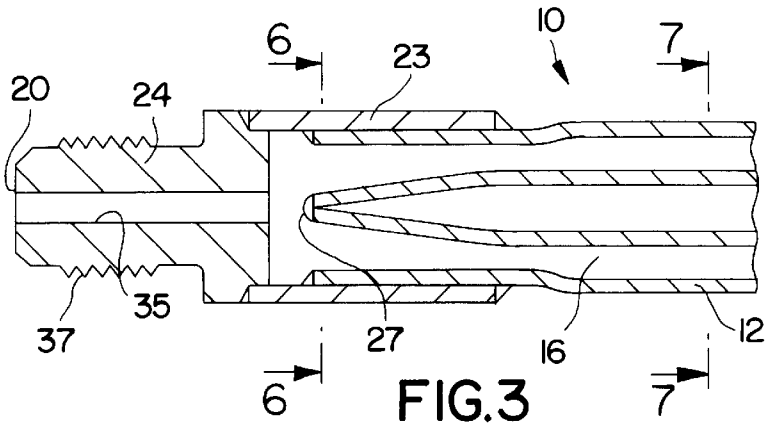
FIG. 3 shows a section through the other end of the rock bolt according to the invention.
Figure 2:
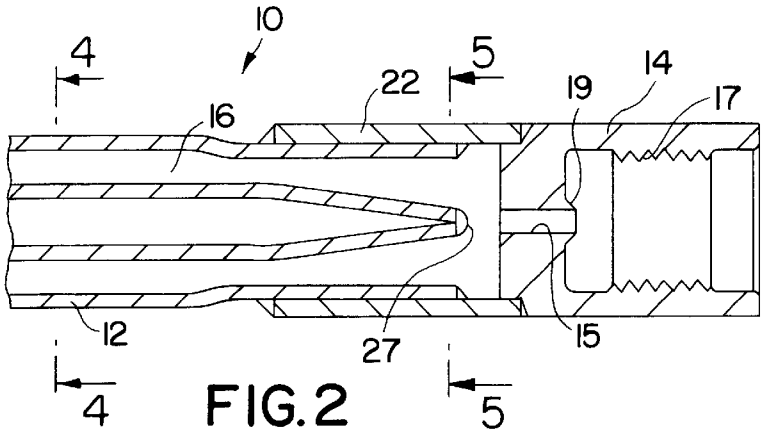
FIG. 2 shows a section through one of the ends of a rock bolt according to the invention.
Figure 7:
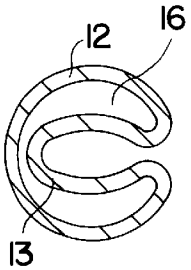
FIG. 7 shows a section according to 7—7 in FIG. 3.
Figure 6:
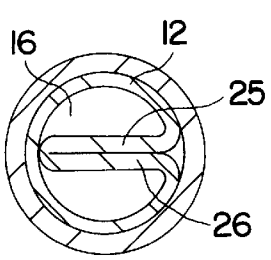
FIG. 6 shows a section according to 6—6 in FIG. 3.
Figure 5:
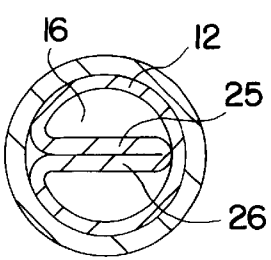
FIG. 5 shows a section according to 5—5 in FIG. 2.
Figure 4:
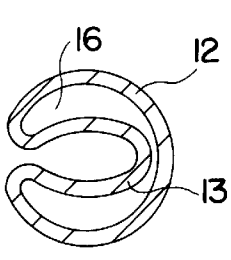
FIG. 4 shows a section according to 4—4 in FIG. 2.
Figure 9:
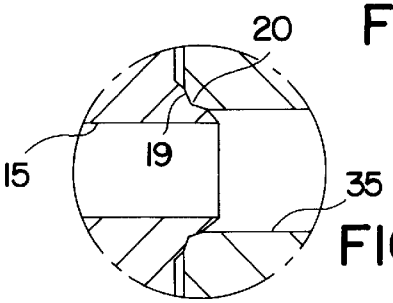
FIG. 9 shows on a larger scale a detail from FIG. 8.
Figure 8:
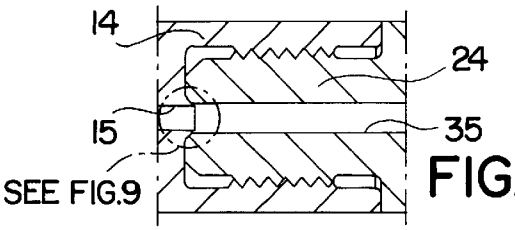
FIG. 8 shows two bolt ends according to FIG. 2 and FIG. 3 screwed together.

In FIG. 1 is shown schematically the setting of a rock bolt 10 which comprises a number of rock bolts connected with one another. The rock bolt, which is described more in detail below, is set by expanding the rock bolt against the bore hole wall 11 by supplying high pressure liquid, preferably water, from a high pressure pump 39 via a valve 42, a tube 59, a hose 41 and a chuck 21 to a room in the rock bolt. The chuck can be made as described in U.S. Pat. No. 4,423,986. In FIGS. 2 and 3 two different ends of a rock bolt 10 according to the invention are shown. The bolt ends 14,24 which are shown in these figures can represent either two ends of the same rock bolt or two ends of two different bolts which are to be connected with one another. The rock bolt comprises an elongated tube 12 which along the major part of its length is provided with a depressed part 13. A sleeve 22 is by means of welding secured to one end of the tube 12. An end piece 14 is welded to the sleeve 22. A sleeve 23 is welded to the other end of the tube 12. An end piece 24 is welded to the sleeve 23. Both branches 25,26 of the depressed part 13 are at both ends of the tube 12 pressed together and by means of welds 27 sealingly connected with one another. Through this the tube 12 defines a room 16 whose only connection with the surroundings is constituted by the channels 15 and 35 through the end pieces 14 and 24. The end piece 14 is provided with an internal thread 17 and the end piece 24 with an external thread 37 by means of which two rock bolts can be connected with one another. In the shown example the end piece 14 is provided with a raised periphery 19 about the channel 15. This raised periphery is intended for cooperation with a channel periphery 20 on the end piece 24. Through deformation of the material sealing cooperation is obtained as shown in FIG. 9. The channel 35 has a somewhat larger diameter than the channel 15. It is, of course, possible to form the sealing parts in an arbitrary way within the scope of the claim.

Figure 10:
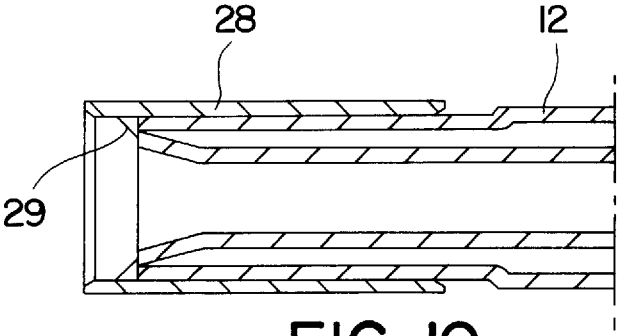
FIG. 10 shows the upper end of a top bolt for cooperation with a rock bolt according to the invention.

In FIG. 10 the upper end of a rock bolt intended for use at the bottom of the bore hole is shown. The tube 12 is provided with a sleeve 28 which by means of a weld 29 is sealingly connected with the tube 12. The not shown end is provided with a thread according to any of the above described embodiments.

Figure 11:
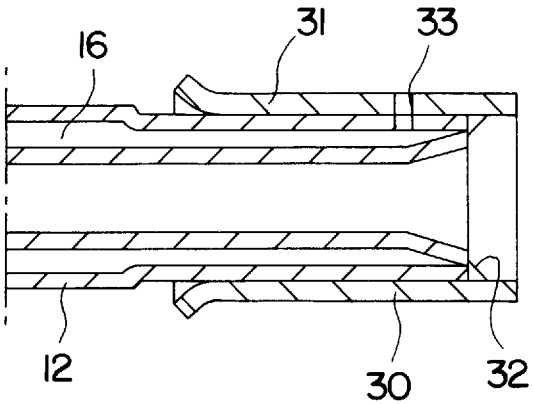
FIG. 11 shows a lower end of a rock bolt for cooperation with a rock bolt according to the invention.

In FIG. 11 is shown the lower end of a rock bolt which is intended for use at the bore hole mouth for connection to the chuck 21 and thus to the high pressure pump 39. The tube 12 is provided with a sleeve 31 which by means of a weld 32 is sealingly connected with the tube 12. A radial hole 33 extends through the sleeve 31 and the outer surface of tube 12 so that the room 16 can be pressurized via the chuck 21. The other end of the rock bolt is as above provided with a thread. As an alternative to this rock bolt one can use a thick-walled tube at the mouth of the hole if it is desired that the joined rock bolt should not extend all the way to the mouth of the bore hole. One can then after the rock bolt has been set fix different fittings in the threaded end piece. Another advantage, which is obtained if one lets the rock bolt end in the bore hole, is that the rock bolt does not extend beyond the rock surface. Through this large amounts of concrete can be saved if the rock surface is to be covered by means of spraying.

Figure 12:
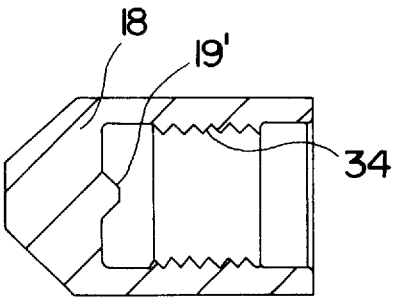
FIG. 12 shows an end sleeve which can be used instead of the top bolt according to FIG. 10.

In FIG. 12 is shown a termination piece 18 which can replace the rock bolt according to FIG. 10. The termination piece 18 is provided with a thread 34 and a protrusion 19' sealingly cooperate through deformation with the channel periphery 20 of the end piece 24 for connection to a rock bolt according to the above.

We claim:

1. A tube-formed rock bolt comprising an elongated tube (12) with closed cross section and provided with a longitudinal depressed part (13) which at expansion of the rock bolt increases in diameter without stretching the periphery of the tube, and an end piece (14) provided with an axial channel (15) connected to a space (16) defined by said tube (12), characterized in that said end piece (14) is provided with a thread (17) for connection with a further rock bolt (10), and that the raised periphery (19) of said channel (15) is formed to sealingly cooperate through deformation with a channel periphery (20) of an end piece (24) on said further rock bolt.

2. A tube-formed rock bolt comprising an elongated tube with closed cross section and provided with a longitudinal depressed part (13) which at expansion of the rock bolt increases in diameter without stretching the periphery of the tube, and an end piece (24) provided with an axial channel (35) connected to a space (16) defined by said tube (12), characterized that said end piece (24) is provided with a thread (37) for connection with a termination piece (18), and that a protrusion (19') of said termination piece (18) is formed to sealingly cooperate through deformation with a channel periphery (20) of said end piece (24).

* * * * *